US005549836A

United States Patent [19]

Moses

[11] Patent Number: 5,549,836

[45] Date of Patent: Aug. 27, 1996

[54] VERSATILE MINERAL OIL-FREE AQUEOUS LUBRICANT COMPOSITIONS

[76] Inventor: David L. Moses, P.O. Box 955, Mercer Island, Wash. 98040

[21] Appl. No.: 495,189

[22] Filed: Jun. 27, 1995

[51] Int. Cl.[6] ..... C10M 173/00

[52] U.S. Cl. ..... 508/183; 508/167; 508/208; 508/211; 508/212; 508/487; 508/488; 508/489

[58] Field of Search ..... 252/49.5, 25, 49.3, 252/496

[56] References Cited

U.S. PATENT DOCUMENTS

| | | | |
|---|---|---|---|
| 3,873,458 | 3/1975 | Parkinson | 252/49.5 |
| 3,879,302 | 4/1975 | Reick | 252/49.5 |
| 3,933,656 | 1/1976 | Reick | 252/25 |
| 4,212,750 | 7/1980 | Gorman | 252/49.5 |
| 4,237,021 | 12/1980 | Andlid et al. | 252/49.5 |
| 4,242,211 | 12/1980 | Nagura | 252/25 |
| 4,256,591 | 3/1981 | Yamamoto et al. | 252/49.5 |
| 4,257,902 | 3/1981 | Singer | 252/49.5 |
| 4,354,949 | 10/1982 | Eggers et al. | 252/49.5 |
| 4,465,607 | 8/1984 | Cottell | 252/25 |
| 4,466,909 | 8/1984 | Stayner | 252/49.5 |
| 4,749,500 | 6/1988 | Forsberg et al. | 252/49.5 |
| 4,770,803 | 9/1988 | Forsberg | 252/49.5 |
| 4,787,991 | 11/1988 | Morozumi et al. | 252/25 |
| 4,800,034 | 1/1989 | Akao et al. | 252/49.5 |

OTHER PUBLICATIONS

1247414 Russian English Abstract Jul. 30, 1986.
62–86096 Japanese English Abstract Apr. 30, 1987.
1–230697 Japanese English Abstract and English Translation 10 Mar. 1988.

*Primary Examiner*—Margaret Medley

[57] ABSTRACT

A substantially mineral oil-free aqueous composition useful to produce a dry lubricant film comprising water; a silicone oil, a vegetable oil or a mixture thereof; at least one waxy film-forming material selected from at least two of the following three groups: (a) saturated $C_{10}$–$C_{24}$ aliphatic monohydric alcohols, (b) saturated $C_{10}$–$C_{24}$ aliphatic monocarboxylic acids, and (c) saturated or monounsaturated $C_{10}$–$C_{24}$ aliphatic primary amides; and an anionic surfactant; nonionic surfactant or mixture thereof capable of stably dispersing the oil and film-forming mixture in the water.

12 Claims, No Drawings

VERSATILE MINERAL OIL-FREE AQUEOUS LUBRICANT COMPOSITIONS

TECHNICAL FIELD

This invention relates to substantially mineral oil-free aqueous compositions useful to produce a dry lubricant film.

BACKGROUND OF INVENTION

Mineral oil-based lubricants suffer from the drawbacks of flammability, disposal problems and other hazards. Accordingly for some time there has been increased interest in developing water-based lubricants. Compositions using a mineral oil and/or synthetic lubricant dispersed in water have attained wide spread use in metal working where they are used to flood the work surface during the meta working operation. While a number of patents have issued on such compositions, water-based lubricants have not achieved wide spread use in many applications. Some of the problems with such products are set forth in U.S. Pat. No. 4,439,344 to James J. Albanese.

Therefore it is an object of the invention to provide a basic mineral oil-free aqueous composition which can be formulated into preparations useful in a wide range of lubricating applications including hot or cold rolling, processing aid, metal shaping (i.e., drilling, cutting, drawing, etc.), general lubrication, gun lubricant, etc.

It is another object of the invention to provide a substantially mineral oil-free aqueous lubricant which can be formulated for use in aerosol containers as well as pressure spraying, brushing, dipping and dispensed from hand pumped containers and droppers.

It is still another object to provide lubricant compositions that are environmentally responsible permitting disposal with a minimal of problems and costs provide efficient lubrication over a wide range of temperature and are not flammable.

DESCRIPTION OF THE INVENTION

This invention provides a substantially mineral oil-free aqueous lubricant which is applied to produce a dry film useful as a general lubricant and which is suited for modification into lubricant compositions tailored for specific lubricating applications. This basic lubricant comprises a mixture of at least one waxy film-forming material from at least two of (a) saturated $C_{10}$–$C_{24}$ aliphatic monohydric alcohols, (b) saturated $C_{10}$–$C_{24}$ aliphatic monocarboxylic acids and (c) saturated or monounsaturated $C_{10}$–$C_{24}$ aliphatic primary amides, the combination being blended with a silicone oil and/or a vegetable oil to form a uniform mixture which is dispersed in water using a nonionic or anionic surfactant, or a mixture of the two.

The silicone oils are polydimethylsiloxane fluids available at viscosities from about 1000 centistokes to about 30,000 centistokes. Vegetable oils which may be used in place of silicone oil include canola (i.e. rapeseed), jojoba, soya, palm, olive, castor oil and mixtures thereof. The oil assists in forming the uniform blend of waxy alcohol, acid and/or amide which is more easily dispersed in water and also promotes film formation when the lubricant is applied to the surface to be lubricated. Silicone oil improves the operating temperature range for the lubricant films, the water resistance of the films and assists penetration of the lubricant compositions into difficult to reach areas when applied to the surfaces to be lubricated. Accordingly, silicone oils are preferred in the lubricating compositions of the invention which are to be in particularly demanding applications such as gun lubricants and lubricants for bicycle and other chain applications. Vegetable oil is preferred in some industrial applications because of ease of disposal and is particularly preferred in those plants where silicone contamination would be a problem. The ratio of oil to the waxy mixture of alcohol, acid and/or amide is not critical and will generally range from about ten parts of oil to one part of the waxy components to one part of oil to five parts of the waxy components. The higher the amount of oil, the softer the lubricating film produced on applying the composition, and conversely, the lower the amount of oil, the harder the film.

A wide variety of anionic and nonionic surfactants are commercially available. Suitable anionic and nonionic surfactants are described in U.S. Pat. No. 4,466,909 to Robert A. Stayner. The surfactant is preferably present in the amount of about 0.2 to about 6 parts by weight to a hundred parts of the overall lubricating composition.

Since the lubricants of the invention are water based, it is desirable to incorporate an effective amount of an anti-rust additives such as diethanolamine, triethanolamine, other organic and inorganic rust inhibitors and proprietary materials such as Aqualox 2268 from the Alox Corp. of Niagara Falls, N.Y. It is also desirable to incorporate a biocide. Suitable biocides include the Dowicils from Dow Chemical Co. and methylchloroisothiazolinone and methylisothiazolinone, both from Rohm and Haas Co.

In a particular preferred embodiment of polytetrafluoroethylene resin is added to the lubricant composition of the invention by incorporating an ultra-fine particle dispersion of the resin in the aqueous lubricant dispersion of the invention. The polytetrafluoroethylene improves the lubricity, release properties and wear properties of the lubricant films produced by the compositions of the invention. Preferably the polytetrafluoroethylene will constitute between 10% and 40% by weight of the combined alcohol, acid and/or amide. For high pressure applications, molybdenum disulfide should be substituted for the polytetrafluoroethylene. For high temperature applications, graphite should be substituted for the polytetrafluoroethylene.

Other optional ingredients of the lubricating composition of the invention include water softeners such as ethylenediamine tetraacetic acid and nitrilotriacetic acid, dyes, odorants such as lemon oil and the like, antifreeze additives to improve storability under freezing conditions, a defoamer where silicone oil is not used and a peptizing cleaner, i.e. a surfactant causing impurities on the surface being lubricated to disperse into colloidal form. Examples of such cleaners are Winsol 88119, a sodium laureth sulfate surfactant, and Winsol 10001, an anionic-nonionic blend, both available from Winsol Laboratories, Inc. of Seattle, Wash.

The aqueous phase of the compositions of the invention constitute from about 20% to about 95% by weight of the overall composition, depending on the application. Thus in a composition used in an aerosol can using dimethyl ether as the propellant, with dimethyl ether constituting 20% by weight of the overall composition, the aqueous phase made up of the combined dimethyl ether and water could constitute from about 76% by weight to 96% by weight of the overall composition. When used as a metal processing aid in applications such as part forming, cutting, drawing, drilling, etc. the composition of the invention will preferably contain a lesser amount of water as in the range of about 20% to 50% by weight. For general lubrication uses, as a gun lubricant and as a bicycle chain lubricant, the aqueous phase will constitute from about 70% to 95% by weight of the composition. In general it is preferred that the lubricating compositions of the invention contain from about 5% by weight to about 15% by weight of the overall composition of methanol, ethanol or isopropanol as an aid in assisting the evaporation of the water from the films deposited from using the lubricating composition of the invention. In these cases the alcohol constitutes part of the aqueous phase. In aerosol packaging no alcohol is normally used as the propellant, dimethyl ether, serves the same function. When used in large scale industrial applications such as metal processing, it is desirable to omit the alcohol to reduce organic vapors.

The waxy film-forming component of the invention comprises at least one waxy material from at least two of (a) saturated $C_{10}$–$C_{24}$ aliphatic monohydric alcohols; (b) saturated aliphatic monocarboxylic acids; and (c) saturated or monounsaturated $C_{10}$–$C_{24}$ aliphatic primary amides. Using at least one material from at least two of the listed classes of materials is believed to result in better film-forming compositions and improved lubricity. While not critical, each component of the waxy mixture should constitute at least about 10% by weight, and preferably at least about 20% by weight, of the waxy mixture. When the lubricant is to be used in a metal-forming application, it is preferred that the waxy mixture contain an amide, in particular oleamide or erucamide. The use of the amide results in an improved finish on the parts produced with this composition.

The compositions of the invention are produced by blending the silicone oil and/or vegetable oil with the waxy ingredients at about 65°–90° C. and moderate stirring to produce a uniform mixture while still hot. This mixture is then added to about half the water with moderate stirring, the surfactant dispersed in a small amount of water is added while stirring. The balance of the water is added followed by the alcohol, if used. The mixture is stirred vigorously to produce a stable dispersion. If optional ingredients are used they are preferably added either with the surfactant or with the final portion of water. Bubbles should be avoided, but if some form the mixture should be allowed to stand to permit the bubbles to dissipate before the lubricant is packaged. A vacuum may be used to remove the bubbles, if desired.

EXAMPLE 1

| Ingredients | Parts by weight |
|---|---|
| (a) Silicone fluid, 5000 cst. | 4.09 |
| (b) Silicone fluid, 1000 cst | 2.41 |
| (c) Octadecanol | 3.25 |
| (d) Stearic acid | 3.25 |
| (e) Corrosion inhibitor | 2.0 |
| (f) Surfactant | 0.33 |
| (g) Polytetrafluoroethylene dispersion | 2.3 |
| (h) Biocide | 0.1 |
| (i) Peptizing cleaner | 1.0 |
| (j) Ethanol | 10.0 |
| (k) Deionized water | 71.27 |

(a) and (b) Polydimethylsiloxane from Dow Corning Corp.
(c) Alfol 18 NF from Vista Chemical
(d) Hystrene 9718 NF from Humko Chemical Div., Witco Corp.
(e) Alox 2268 (containing 2-(methylamino) ethanol) from Alox Corp.
(f) Tergitol 15-S-9, a mixture of $C_{12}$–$C_{14}$ secondary alcohols ethoxylated to a molecular weight of 596, from Union Carbide
(g) Fluotron 110, ultra-fine particle size polytetrafluoroethylene dispersion, 42% solids, from Carroll Scientific, Inc.
(h) 1-(3-chloroallyl)-3,5,7,triaza-1-azoniaadamantane from Dow Chemical Co. as Dowicil 75
(i) Winsol 10001, an anionic and nonionic surfactant blend from Winsol Laboratories, Inc.
(j) Anhydrol Solvent Special, PM-4085 from Union Carbide Ingredients from (a) through (e) were placed together in a container, and heated to about 70° C. and stirred slowly until the ingredients were blended. Ingredients (f) through (i) were blended with about 10% water. About half the remaining water was placed in a container equipped with a high shear blender. Stirring was begun on low and the hot mixture of ingredients (a) through (e) added. Stirring speed was increased to medium and the dispersion of the remaining ingredients added. After about 20–30 seconds the remaining water and the ethanol were added. Stirring speed was increased until a stable dispersion was obtained. This occurred in about forty-five seconds.

The resulting composition has outstanding properties as a general purpose lubricant and is particular useful as a firearms cleaner/lubricant. This composition is also useful as an aerosol formulation. In this application the ethanol is omitted and 80 parts of the formulation (less the ethanol) together with 20 parts of dimethyl ether are charged to an aerosol can. The resulting product was easily sprayed to produce films having good lubricant properties.

Enthusiastic shooters commonly collect spent casings which they reload. The hand reloaders used for this purpose provide a die sized for the particular casing and means for applying pressure to drive the casing into the die thereby sizing it to the correct dimensions. When prior art lubricants containing mineral oil and/or synthetic lubricants are used as is, in a grease or in emulsion form, the forces necessary for sizing result in a high rate of rejections, poor finishes, and exposure to hazardous solvents. Furthermore, spent casings by their nature are contaminated by spent powder particles and, often, by dirt contacting the casing after ejection from the gun. Heretofore a separate cleaning operation is needed to minimize wear and abrasion of the case and to prevent buildup of dirty scum in the die. In contrast, when the composition in Example 1 is used to produce a dry lubricant film on the casing, less force is needed(an important consideration as the devises used are hand operated) and very few rejects are produced. In addition, no separate cleaning step is needed as the composition of Example 1 cleans as well as lubricates resulting in smoother and cleaner casings and no buildup of scum in the die. The work place also becomes safer as there are no hazardous solvents.

EXAMPLE 2

Example 1 was repeated with the following changes: ingredient (a) was increased to 6.34 parts by weight and ingredient (b) to 3.6 parts; ingredient (c) was decreased to 2 parts, ingredient (d) to 1.33 parts and the water to 71 parts.

The composition of Example 2 was highly efficient when used on bicycle chains in maintaining an effective lubricant film when the bicycles are used under wet conditions.

EXAMPLE 3

Example 2 was repeated with the following changes: the biocide, ingredient (l) was omitted; the water, ingredient (k), was decreased to 68.92 parts; and 12.18 parts by weight of isopropanol were substituted for the ethanol, ingredient (j).

Two teams of three experienced shooters each were used to test the composition of Example 3 as a lubricant/cleaner for small arms. The guns used were a 0.45 Colt pistol, an AR-15 (civilian version of an M-16) and an SKS Simonov (a Chinese version of a Soviet assault rifle). Prior to firing each team cleaned their firearms to U.S. Army standards, the one team using the product of this example, the other team using Break-Free, a product presently used by the U.S. Army.

Each weapon was used to fire thirty rounds. Each of the weapons using the composition of this example had relatively little carbon build up and each of the weapons were cleaned up within one hour. Each of the weapons using Break-Free had large deposits of carbon and took from two to three hours to clean.

In a second test Glock 0.45 caliber semiautomatic pistols were used. Two of the weapons were cleaned with Hoppes solvent and then lubricated with Hoppes oil, and the other two weapons were cleaned with the composition of this example with no separate lubricant being added.

Four rounds were fired using one of the control (Hoppes) weapons. There were signs of leading in the throat and deposits of black powder. When a dry patch was run through the barrel the lead was not removed, but some of the powder was. Four rounds were fired through one of the weapons cleaned with the composition of this example. A small amount of leading was noted in the throat but no powder residue was observed. One pass with a dry patch through the barrel removed the lead along with a small amount of debris.

Eight rounds were fired using the second control (Hoppes) weapon and fifty rounds were continuously fired through the second weapon which used the composition of the invention. The control weapon took over 30 minutes to clean using Hoppes solvent while the other weapon was cleaned in about 10 minutes using the composition of this example.

| | EXAMPLE** | | | |
|---|---|---|---|---|
| Ingredients | 4 | 5 | 6 | 7 |
| (a) Silicone fluid, 5000 cst | 5.22 | 5.22 | 5.22 | 5.22 |
| (b) Silicone fluid, 1000 cst | 3.03 | 3.03 | 3.03 | 3.03 |
| (c) Octadecanol | — | 2.63 | — | — |
| (d) Stearic acid | 2.29 | — | 2.29 | 2.29 |
| (e) Corrosion inhibitor | 2.0 | 2.0 | 2.0 | 2.0 |
| (f) Surfactant | 0.33 | 0.33 | 0.33 | 0.33 |
| (g) Peptizing cleaner | 1.0 | 1.0 | 1.0 | 1.0 |
| (h) Ethanol | 11.5 | 11.5 | 11.5 | 11.5 |
| (i) Deionized water | 72.43 | 71.66 | 72.0 | 72.43 |
| (j) Decanol | 2.2 | — | — | — |
| (k) Stearamide | — | 2.63 | — | — |
| (l) Erucamide | — | — | 2.63 | — |
| (m) Tetradecanol | — | — | — | 2.2 |

**All parts are by weight
All of (a) through (h) are as set forth in Example 1
(j) Alfol 10 from Vista Chemical Co.
(k) Crodamide SR from Croda Universal, Inc.
(l) Crodamide ER from Croda Universal, Inc.
(m) Alfol 14 from Vista Chemical Co.

Each of the compositions of Examples 4–7 was made up following the procedure of Example 1 but substituting decanol for octadecanol in Example 4, stearamide for stearic acid in Example 5, erucamide for octadecanol in Example 6 and tetradecanol for octadecanol in Example 7.

The lubricating properties of Examples 4–7 were tested by drilling holes ¼ inch deep into a sheet of hardened steel. The diameter of the holes matched the diameter of hardened steel rods. The circumference of the bottom end of the rods was filed to produce an angled surface that matched the angled portion of the bottom of the hole produced by the drill. This resulted in surface to surface contact between the bottom of the hole and the angled portion of the bottom of the rod. The lubricant of each example was placed in separate holes, the hardened rods were put into a drill chuck, the drill turned on and the rods put into the respective reservoirs at a load of 200 lbs. The drill was run until failure or 60 seconds, whichever occurred first. No smoke was produced in any of the tests and in each case the surface of the rod was smooth and polished. In examples 4 and 6 the rods were slightly warm, while in Examples 5 and 7 the rods were cool to the touch.

What is claimed is:

1. A substantially mineral oil-free aqueous dispersion useful to produce a dry lubricant film comprising:

(a) about 20° to about 95% by weight of an aqueous phase;

(b) about 0.2% to about 6% by weight of an anionic surfactant, nonionic surfactant or mixture thereof; and (c) the balance a mixture of (i) a silicone oil, vegetable oil or combination thereof and a waxy film-forming material from at least two of the three groups saturated $C_{10}$–$C_{24}$ aliphatic monohydric alcohols, saturated $C_{10}$–$C_{24}$ aliphatic monocarboxylic acids and saturated or monounsaturated $C_{10}$–$C_{24}$ aliphatic primary amides;

the surfactant stably dispersing the mixture in the aqueous phase.

2. The composition of claim 1 further including a finely divided dispersion of polytetrafluoroethylene.

3. The composition of claim 1 further including a peptizing cleaner.

4. The composition of claim 1 useful as a metal-forming lubricant wherein one of the waxy film-forming materials is a saturated or monounsaturated $C_{10}$–$C_{24}$ aliphatic primary amide and the oil is vegetable oil.

5. The composition of claim 1 further including a finely divided dispersion of polytetrafluoroethylene, a peptizing cleaner, an anti-rust additive, and a biocide.

6. The composition of claim 1 wherein the oil is a silicone oil.

7. The composition of claim 1 wherein the oil is a silicone oil and further including a finely divided dispersion of polytetrafluoroethylene.

8. The composition of claim 1 wherein the oil is a vegetable oil.

9. The composition of claim 1 wherein the aqueous phase further contains from about 5% by weight to about 15% by weight of the overall composition of at least one of methanol, ethanol or isopropanol.

10. The composition of claim 1 further including molybdenum disulfide.

11. A dry lubricant film comprising from about 0.2% to about 6% by weight of an anionic surfactant, nonionic surfactant or mixture thereof, and the balance a mixture of (i) a silicone oil, vegetable oil or combination thereof and (ii) a waxy film-forming material from at least two of the three groups saturated $C_{10}$–$C_{24}$ aliphatic_monohydric alcohols, saturated $C_{10}$–$C_{24}$ aliphatic monocarboxylic acids and saturated or monounsaturated $C_{10}$–$C_{24}$ aliphatic primary amides, wherein the oil is from about 16.7% to 90.9% by weight of the mixture and the waxy film-forming material is from about 83.3% to 9.1% by weight of the mixture.

12. The dry lubricant film of claim 11 further including a finely divided dispersion of polytetrafluoroethylene.

* * * * *